United States Patent [19]

Riggs, Jr.

[11] 4,189,357

[45] Feb. 19, 1980

[54] METHOD OF TREATING A SUBSTRATE MATERIAL TO FORM AN ELECTRODE

[75] Inventor: Olen L. Riggs, Jr., Bethany, Okla.

[73] Assignee: Kerr-McGee Corporation, Oklahoma City, Okla.

[21] Appl. No.: 949,974

[22] Filed: Oct. 10, 1978

[51] Int. Cl.[2] ..... C25D 9/06

[52] U.S. Cl. ..... 204/29; 204/96

[58] Field of Search ..... 204/129.95, 129.75, 204/29, 96

[56] References Cited

U.S. PATENT DOCUMENTS 3,841,978 10/1974 Lai ..... 204/29

OTHER PUBLICATIONS

"Electrodes of Thick Coatings of Pt. & Pd. on Refractory Metals for Aqueous Electrolytes," Cramer et al., Bur. of Mines, R. I., 9/67, p. 50.

*Primary Examiner*—R. L. Andrews

*Attorney, Agent, or Firm*—William G. Addison

[57] ABSTRACT

The present invention relates to an improved method of treating a substrate material selected from the group consisting of titanium, tantalum, zirconium, niobium, hafnium and their alloys to form an electrode. Broadly, the improved method comprises anodically treating the substrate material in an electrolyte containing fluoride ions under controlled potential conditions.

6 Claims, 2 Drawing Figures

POTENTIODYNAMIC ANODIC POLARIZATION OF TITANIUM ELECTRODES TREATED AT PRESELECTED CONTROLLED POTENTIALS VERSUS A SCE

POTENTIODYNAMIC ANODIC POLARIZATION OF TITANIUM ELECTRODES TREATED AT CONSTANT CURRENT DENSITY

POTENTIODYNAMIC ANODIC POLARIZATION OF TITANIUM ELECTRODES TREATED AT PRESELECTED CONTROLLED POTENTIALS VERSUS A SCE

METHOD OF TREATING A SUBSTRATE MATERIAL TO FORM AN ELECTRODE

BACKGROUND OF THE INVENTION

1. Field of the Invention

An improved method of treating a substrate material in an electrolyte containing fluoride ions wherein the substrate is anodically treated under controlled potential conditions to form an electrode.

2. Description of the Prior Art

It is known to produce electrolytic manganese dioxide from an electrolyte comprising a manganese sulfate-sulfuric acid solution. The manganese dioxide is deposited on the anode under carefully controlled conditions of electrolysis to produce a deposit having certain desired properties. The manganese dioxide so produced is recovered and used, for example, as a depolarizer for batteries.

When graphite is used as the anode in such an electrodeposition process, the current efficiency generally is limited to less than about 90%. Further, the manganese dioxide is strongly attached to the graphite surface and subsequent removal of the manganese dioxide also results in removal of particles of graphite, which necessarily contaminate the manganese dioxide. Moreover, it is difficult to remove the deposited manganese dioxide without damaging the graphite anode.

Certain other materials also have been suggested for use as anodes in the electrodeposition of manganese dioxide, such as, for example, platinum, platinum plated titanium and other noble metals and their oxides. The cost of such anodes is too high for an economical commercial operation. Titanium is substantially impervious to most corrosive environments (such as electrolytes), however, its susceptibility to passivation has limited its acceptance as a suitable anode material.

In U.S. Pat. 2,608,531 there is suggested a process for preparing electrolytic manganese dioxide using a particular type of titanium anode. Specifically, the patent discloses an anode consisting essentially of titanium particles compacted into a coherent but incompletely consolidated porous mass. However, such an anode is weak in mechanical characteristics and subject to breakage.

In U.S. Pat. 3,436,323 it is suggested that the disadvantages of a compacted titanium anode can be overcome by using an anode having a finely and sharply indented aventurine surface. Such surface preferably is obtained by sand blasting the surface of the anode. It has been found, however, when using such an anode, that an anodic current density in excess of about 9 amps per square foot results in passivation of the titanium anode surface.

Passivation is indicated by an increase in the electrical resistance of the anode. An increase in resistance necessarily requires an increase in the voltage applied to the anode to maintain a constant current density and also results in a corresponding increase in power consumption.

More recently, in U.S. Pat. 3,841,978 there is suggested a process for anodically treating a substrate material in an electrolyte comprising an aqueous solution containing fluoride ions and at least one compound selected from the group consisting of ethylene glycol, acetic acid and a mixture of phosphoric acid and nitric acid. The substrate is anodically treated at an anodic current density of at least 10 amps per square foot.

During the treatment a gray film forms on the surface of the anode. The treatment time is a function of the current density applied during treatment. If the treatment time is of excessive duration, the film peels or flakes off the substrate material.

It is desirable to provide a method for treating a substrate material such that electrodes produced thereby will exhibit substantially similar behavioral characteristics during usage.

SUMMARY OF THE INVENTION

An improved method now has been discovered for treating a substrate material selected from the group consisting of titanium, tantalum, zirconium, niobium, hafnium and their alloys whereby it is suitable for use as an electrode, for example, in the electrodeposition of manganese dioxide. In accordance with the present method the substrate material to be treated is placed in an electrolyte comprising an aqueous solution containing fluoride ions and at least one compound selected from the group consisting of ethylene glycol, acetic acid and a mixture of phosphoric acid and nitric acid. The electrolyte is connected by a suitable salt bridge to a reference cell, such as for example, a silver/silver chloride electrode cell or a standard calomel electrode cell. Thereafter, the substrate material is anodically treated at an anodic current density sufficient to maintain a preselected control potential between the substrate and the reference cell. The treatment results in the formation of a substantially uniform adherent gray film upon the surface of the substrate. It has been found that electrodes produced in accordance with the present method exhibit substantial reproducibility, that is, the electrodes exhibit substantially similar behavioral characteristics during usage. Further, the electrode can be used as an anode in the electrodeposition of manganese dioxide at current densities of up to about 30 amps per square foot. After repeated electrodeposition and stripping, the surface of the substrate does not passivate, peel or flake or show any evidence of corrosion.

DESCRIPTION OF THE PREFERRED EMBODIMENT

Figure 1:
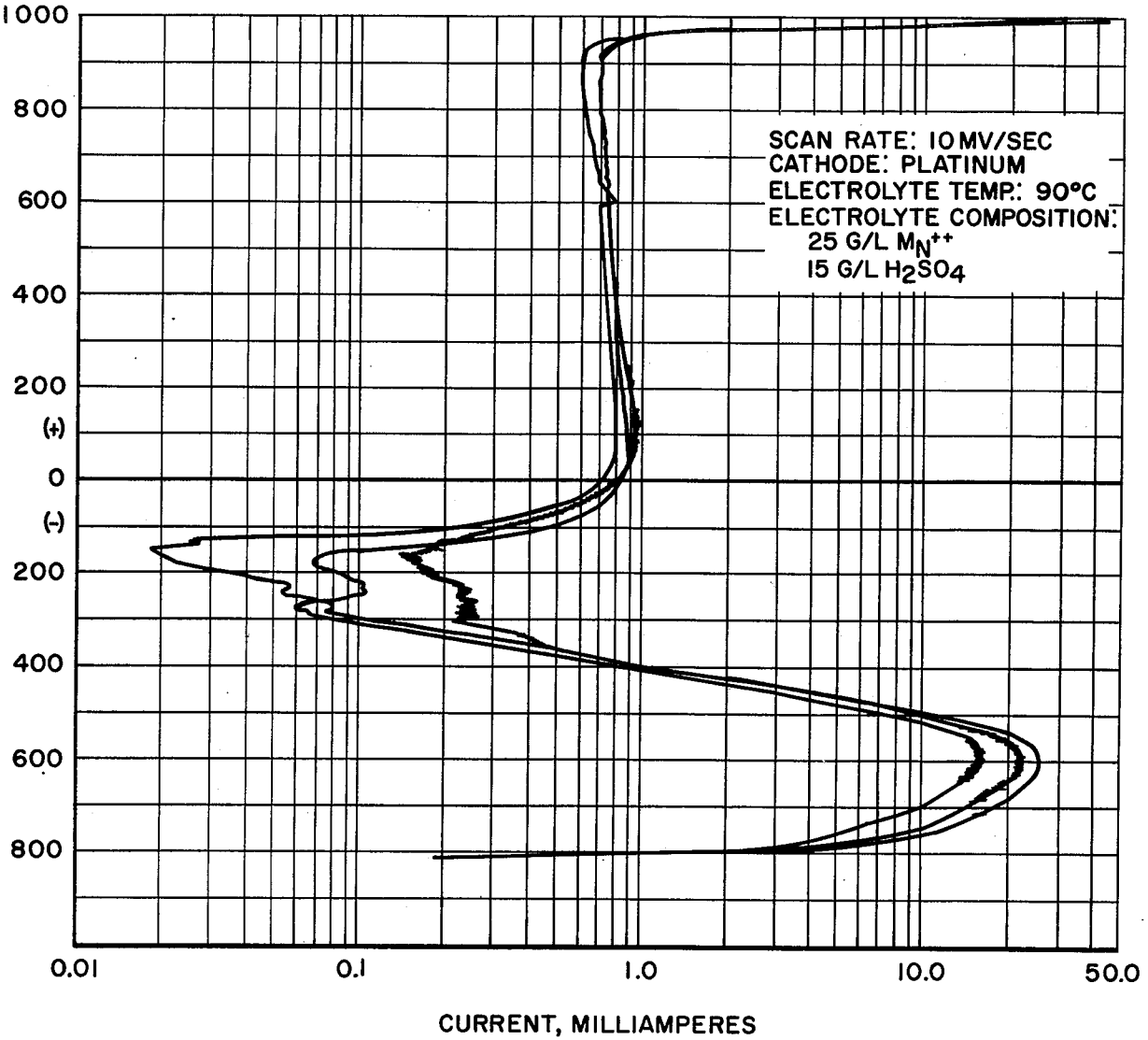
FIG. 1 is a graphical illustration of potentiodynamic polarization curves for titanium electrodes treated at constant current density.

In accordance with the present invention the substrate material to be treated is made the anode in an electrolytic cell which also contains a suitable cathode. The cathode material is not critical and suitable materials include copper, nickel, mild steel, stainless steel, graphite, platinum and the like.

The cell contains an electrolyte comprising an aqueous solution of fluoride ions and at least one compound selected from the group consisting of ethylene glycol, acetic acid and a mixture of phosphoric acid and nitric acid.

The cell is connected by a suitable salt bridge to a reference cell. The reference cell may comprise, for example, a standard calomel electrode cell in which case the salt bridge preferably is agar-agar saturated with potassium chloride.

The substrate material may be titanium. The term "titanium" as used herein includes not only titanium but its alloys such as, for example, Ti-13V-11Cr-Al, Ti-6Al-6V-2Sn and Ti-8Al-1Mo-1V. Also contemplated herein as suitable substrate materials are metals selected from the group consisting of tantalum, zirconium, niobium, hafnium and their alloys.

The titanium may be in any form such as, for example, bar, plate, flat sheet, sheets of expanded metal and the like. A preferred form for subsequent use in the electrodeposition of manganese dioxide is disclosed in U.S. Pat. 3,654,102.

The composition of the electrolyte is critical. The concentration of fluoride ion in the electrolyte must be at least about 25 grams per liter of electrolyte. Generally, it is desirable that the fluoride ion concentration be maintained within a range of from about 55 to 75 grams per liter. Particularly good results have been obtained with a fluoride concentration of about 70 grams per liter.

The source of fluoride ion is not critical. The fluoride may be introduced into the electrolyte in the form of an aqueous solution of hydrofluoric acid, by bubbling fluorine gas through the electrolyte and the like. Other sources of fluoride ion include sodium fluoride, potassium fluoride, magnesium fluoride, zinc fluoride, trifluoroacetic acid and other inorganic and organic fluoride compounds. Generally, it is preferred to use an aqueous solution of hydrofluoric acid as the source of fluoride ion.

Further, the electrolyte also must contain at least one other compound, either acetic acid, ethylene glycol or a mixture of phosphoric and nitric acid. Such other compound should be present in an amount within the range of from about 700 to 1300 grams per liter of electrolyte and preferably within the range of from about 800 to 1200 grams per liter. The optimum concentration will depend, among other things, on the particular compound selected. When using ethylene glycol or acetic acid, it generally is preferred to maintain a concentration of from about 850 to 1000 grams per liter.

When using a mixture of phosphoric and nitric acid, however, it is advantageous to maintain the concentration within the range of from about 800 to 1200 grams per liter and preferably within the range of from about 900 to 1100 grams per liter. Further, when the other compound is a mixture of phosphoric and nitric acid, the weight ratio of phosphoric to nitric acid should be within the range of 5:1 to 2:3 and preferably within the range of from 3:1 to 3:2.

The actual part played by the fluoride and the other compound in this treating method is not fully understood and the inventor does not wish to be bound by a particular theory. However, it has been found that when the substrate material is treated in accordance with the present method, it may be used in a manganese dioxide electrodeposition process at higher current densities and for longer periods of time, without passivation occurring, than would otherwise be possible.

The substrate material, after being placed in the electrolyte is anodically treated at an anodic current density sufficient to maintain a preselected control potential between the substrate and the reference cell. The reference electrode in the reference cell senses the electrochemical potential of the substrate and through a control circuit such as, for example, a potentiostat, causes the electrical current and voltage to vary as required to maintain the preselected potential value. A preferred form of a control circuit for commercial use is disclosed in U.S. patent application Ser. No. 335,397 filed Mar. 10, 1978. The preselected control potential is a function of the particular reference electrode cell employed in the treating method. The control potential value may be adjusted to compensate for the differences between various other reference electrodes and the reference potential of a standard calomel electrode (hereafter SCE). The magnitude of the adjustment is on the order of the difference between the other electrode's reference potential and the reference potential of a SCE. The control potential selected when a standard calomel electrode reference cell is employed is in the range of from about 7 volts to about 9 volts. Preferably, the control potential is in the range of from about 7.9 volts to about 8.1 volts versus a SCE.

The treatment time generally is within the range of from about 2 minutes to about 30 minutes. During the treatment an adherent grayish film forms on the surface of the substrate. The film is substantially uniform across the surface of the substrate.

Temperature does not appear to be a critical parameter in the treatment method of the present invention. In fact, within a temperature range of from about 20° C. to about 50° C. substantially no difference in the efficacy of the invention is observed.

After the substrate material has been treated in accordance with the present method, it then is removed from the electrolytic cell and preferably washed with water prior to its use in an electrolytic cell. A substrate material treated in accordance with the present invention is particularly useful in the electrodeposition of manganese dioxide.

More particularly, the treated substrate is used as the anode in an electrolytic cell for the electrodeposition of manganese dioxide. The cell contains an electrolyte comprising an aqueous solution containing manganous ion in a concentration of from about 15 to 50 grams per liter and from about 10 to 40 grams per liter sulfuric acid. The electrolyte temperature is maintained within a range of from about 90° to 98° C. to optimize current efficiency. When the substrate has been treated in accordance with the method of the instant invention it is possible to operate the cell at an anodic current density of from about 8 to 30 amp/ft$^2$ or even higher. Generally, it is preferred to maintain the anodic current density within the range of from about 12 to 20 amp/ft$^2$.

The following examples are set forth for the purpose of illustration only and are not to be construed as limiting the scope of this invention.

EXAMPLE 1

The purpose of this example is to demonstrate electrode reproducibility through a comparison of three substrate samples treated by a method using constant current density with three substrate samples treated by the method of this invention.

Three untreated strips of titanium are obtained. Each strip is placed in an electrolytic cell as the anode. The cathod is copper. The electrolyte in the cell comprises 112 ml/1 HF (49%) and 888 ml/1 glacial acetic acid. An electric current is caused to flow through the titanium strips in an amount sufficient to provide an anodic current density of about 14 amps per square foot for 10 minutes. The treated titanium strip then are removed and rinsed in water.

The treated titanium strips then are used in a potentiodynamic polarization test. Each strip is used as the anode in an electrolytic cell in which the electrolyte comprises a manganese sulfate-sulfuric acid solution. The electrolyte contains about 25 gm/1 of manganous ion ($Mn^{++}$) and 15 gm/1 of $H_2SO_4$. The electrolyte is maintained at a temperature of about 90° C. The cathode is platinium. The potentiometric scan rate is 10 millivolts per second. The results of the tests are graphically illustrated in FIG. 1.

Three additional untreated strips of titanium are obtained. Each strip is placed in an electrolytic cell as the anode. The cathode is copper. A standard calomel electrode reference cell is connected to each electrolytic cell through a salt bridge containing agar-agar saturated with KCl. The electrolyte in the cell comprises 112 ml/1 HF (49%) and 888 ml/1 glacial acetic acid. The strips are connected to a potentiostat to effect controlled potential selection during the anodic treatment. The potentiostat is adjusted to maintain an 8 volt potential versus the SCE in the reference cell for 10 minutes. The titanium strips treated by the method of this invention then are removed and rinsed in water.

The titanium strips treated by the method of this invention then are used in potentiodynamic polarization tests as hereinbefore described. The results of the tests are graphically illustrated in FIG. 2.

Figure 2:
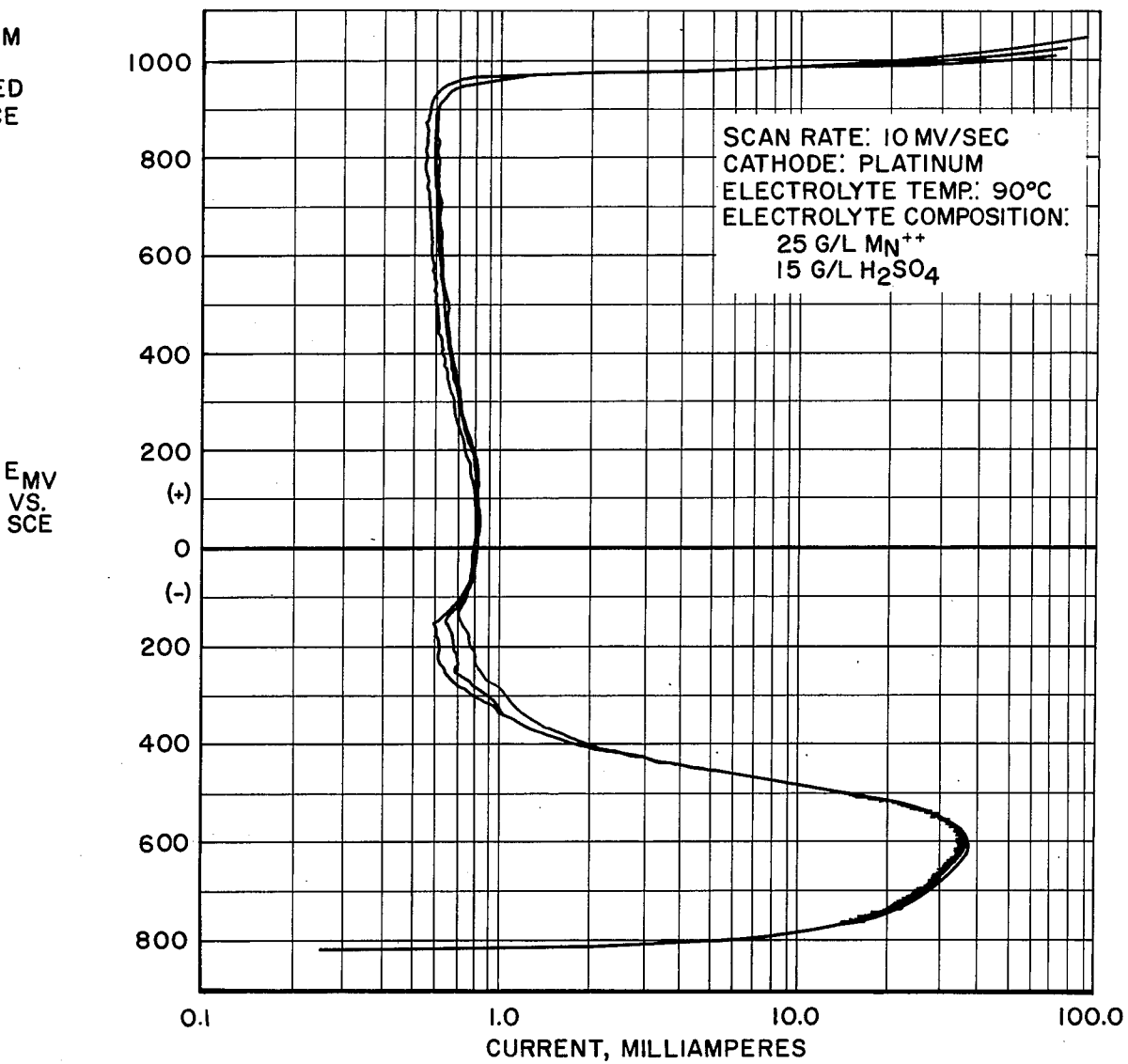
FIG. 2 is a graphical illustration of potentiodynamic polarization curves for titanium electrodes treated at preselected controlled potentials versus a SCE.

This example clearly demonstrates the efficacy of the present invention in providing electrode reproducibility. The substantial current excursions present in the potentiometric scans of the three electrodes treated using constant current density illustrated in FIG. 1 indicate that the electrodes will possess different behavioral characteristics during usage. By way of contrast, the potentiometric scans of the three electrodes treated by the method of this invention illustrated in FIG. 2 are substantially uniform and indicate that the electrodes will exhibit substantially similar behavioral characteristics during usage.

EXAMPLE II

An untreated strip of titanium is obtained and placed in an electrolytic cell as the anode. The cathode is copper. A standard calomel electrode reference cell is connected to the electrolytic cell by a salt bridge. The electrolyte in the cell comprises 112 ml/1 HF (49%) and 888 ml/1 glacial acetic acid. The anode is connected to a potentiostat adjusted to maintain a controlled potential of about 8.0 volts versus the SCE for 10 minutes.

The treated titanium strip then is used as the anode in a manganese dioxide electrodeposition process. The anode is operated at an anodic current density of about 20 amps per square foot for 96 hours, stripped and returned to the process for continued deposition without passivation. When the foregoing process is repeated using an untreated titanium strip as the anode, the cell voltage increases rapidly and passivation occurs.

This example clearly demonstrates the efficacy of the present invention when the treating electrolyte comprises an aqueous solution of fluoride ions and acetic acid.

EXAMPLE III

An untreated strip of titanium is obtained and placed in an electrolytic cell as the anode. The cathode is copper A standard calomel electrode reference cell is connected to the electrolytic cell by a salt bridge. The electrolyte in the cell comprises 50 ml/1 HF (49%), 800 ml/1 $H_3PO_4$ (85%) and 150 ml/1 $HNO_3$ (71%). The anode is connected to a potentiostat adjusted to maintain a controlled potential of about 8.0 volts versus the SCE for 10 minutes.

The treated titanium strip then is used as the anode in a manganese dioxide electrodeposition process. The anode is operated at an anodic current density of about 20 amps per square foot for 96 hours, stripped and returned to the process for continued deposition without passivation. When the foregoing process is repeated using an untreated titanium strip as the anode, the cell voltage increases rapidly and passivation occurs.

This example clearly demonstrates the efficacy of the present invention when the treating electrolyte comprises an aqueous solution of fluoride ions and nitric acid.

EXAMPLE IV

An untreated strip of titanium is obtained and placed in an electrolytic cell as the anode. The cathode is copper. A standard calomel reference cell is connected to the electrolytic cell by a salt bridge. The electrolyte in the cell comprises 120 ml/1 HF (49%), 820 ml/1 ethylene glycol and 60 ml/1 $H_2O$. The anode is connected to a potentiostat adjusted to provide a controlled potential of about 8.0 volts versus the SCE for 10 minutes.

The treated titanium strip then is used as the anode in a manganese dioxide electrodeposition process. The anode is operated at an anodic current density of about 20 amps per square foot for 96 hours, stripped and returned to the process for continued deposition without passivation. When the foregoing process is repeated using an untreated titanium strip as the anode, the cell voltage increases rapidly and passivation occurs.

This example clearly demonstrates the efficacy of the present invention when the treating electrolyte comprises an aqueous solution of fluoride ions and ethylene glycol.

While the present invention has been described with regard to what is considered to be the preferred embodiment thereof, it is to be understood that changes and modifications can be made in the method without departing from the spirit or scope of the invention as defined in the following claims.

What is claimed is:

1. A method for the electrodeposition of manganese dioxide which comprises:

treating a substrate material selected from the group consisting of titanium, tantalum, zirconium, niobium, hafnium and their alloys by providing an aqueous electrolyte containing at least 25 gm/1 fluoride ions and from about 800 to 1200 gm/1 of at least one other compound selected from the group consisting of acetic acid, ethylene glycol and a mixture of nitric acid and phosphoric acid;

providing a reference cell comprising a standard calomel electrode positioned in such manner as to be in ionic contact with the aqueous electrolyte;

placing said substrate material in contact with said aqueous electrolyte;

electrolyzing said electrolyte at sufficient anodic current density to maintain a preselected control potential in the range of from about 7 to about 9 volts between the substrate material and the reference cell to produce a treated substrate material;

placing the treated substrate material in an electrolytic cell as an anode for the electrodeposition of manganese dioxide, said cell containing an electrolyte comprising an aqueous solution of manganous ion in a concentration of from about 15 to 50 gm/1 and from about 10–40 gm/1 sulfuric acid;

electrolyzing the aqueous solution at an anodic current density of from about 5 to 30 amps per square foot to effect electrodeposition of manganese dioxide on the treated substrate material; and recovering said electrodeposited manganese dioxide.

2. The method of claim 1 wherein the preselected control potential is in the range of from about 7.9 to about 8.1 volts versus the standard calomel electrode.

3. The method of claim 1 wherein the concentration of fluoride ions is maintained within a range of from about 55 to 75 gm/1; the selected compound is acetic acid present in an amount within the range of from about 850 to 1000 gm/1 and the control potential is maintained in the range of from about 7.9 to about 8.1 volts versus the standard calomel electrode.

4. The method of claim 1 wherein the reference cell comprises an electrode other than a standard calomel electrode and the preselected control potential is adjusted by the sum of the value of the reference potential of the other electrode less the value of the reference potential of the standard calomel electrode.

5. A method for treating a substrate material to form an electrode which comprises:

providing a substrate material selected from the group consisting of titanium, tantalum, zirconium, niobium, hafnium and their alloys;

providing an aqueous electrolyte containing at least 25 gm/1 fluoride ions and from about 800 to 1200 gm/1 of at least one other compound selected from the group consisting of acetic acid, ethylene glycol and a mixture of nitric acid and phosphoric acid;

providing a reference cell comprising a standard calomel electrode positioned in such manner as to be in ionic contact with the aqueous electrolyte;

placing said substrate material in contact with said aqueous electrolyte as an anode:

placing a cathode in contact with said aqueous electrolyte; and electrolyzing said electrolyte at sufficient anodic current density to maintain a preselected control potential in the range of from about 7 to about 9 volts measured between the substrate material and the reference cell to cause an adherent grayish film to form upon the surface of the substrate material in contact with the aqueous electrolyte.

6. The method of claim 5 wherein the reference cell comprises an electrode other than a standard calomel electrode and the preselected control potential is adjusted by the sum of the value of the reference potential of the other electrode less the value of the reference potential of the standard calomel electrode.

* * * * *